US006000938A

United States Patent [19]

Melanowicz

[11] Patent Number: 6,000,938

[45] Date of Patent: Dec. 14, 1999

[54] AUTOMATED DOOR MECHANISM FOR HEAT TREATING FURNACE

[76] Inventor: Arek Melanowicz, P.O. Box 25, Coxsackle, N.Y. 12051

[21] Appl. No.: 09/179,521

[22] Filed: Oct. 27, 1998

[51] Int. Cl.[6] ..... F27D 1/18

[52] U.S. Cl. ..... 432/250; 432/242

[58] Field of Search ..... 432/242, 250; 49/440; 312/349

[56] References Cited

U.S. PATENT DOCUMENTS

| | | | |
|---|---|---|---|
| 1,109,723 | 9/1914 | White . | |
| 4,026,264 | 5/1977 | Henriques | 126/123 |
| 4,054,411 | 10/1977 | Beck | 432/242 |
| 4,658,545 | 4/1987 | Ingham et al. | 49/340 |
| 4,867,677 | 9/1989 | Ulinski | 432/250 |
| 4,911,508 | 3/1990 | Tillman | 312/319 |
| 5,058,654 | 10/1991 | Simmons et al. | 164/47 |
| 5,147,056 | 9/1992 | Ma | 220/263 |
| 5,163,574 | 11/1992 | Sosan | 220/264 |
| 5,256,061 | 10/1993 | Cress | 432/242 |
| 5,540,012 | 7/1996 | Clegg | 49/70 |
| 5,622,416 | 4/1997 | Rainey et al. | 312/319.9 |

*Primary Examiner*—Teresa Walberg
*Assistant Examiner*—Gregory A. Wilson
*Attorney, Agent, or Firm*—John D. Gugliotta

[57] ABSTRACT

Disclosed is an automated access door for a heat treating furnace that is controlled via a foot pedal switch. The door affords the user with the ability to use both hands to access the interior compartment of the furnace in order to manipulate the objects placed therein.

7 Claims, 4 Drawing Sheets

AUTOMATED DOOR MECHANISM FOR HEAT TREATING FURNACE

BACKGROUND OF THE INVENTION

1. Field of the Invention

The present invention relates generally to industrial heat treating equipment used to strengthen and harden metal alloys, and more specifically to an automated door configuration for use in heat treating furnaces that frees the operator's hands to work with items in the furnace.

2. Description of the Related Art

Heat treating metals in order to enhance their hardness and other physical and metallurgical properties is a process that dates back hundreds of years. Many modern heat treating methods involve the use of furnaces that are used to heat the metal to extreme temperatures in upwards of 2000 degrees Fahrenheit. Subsequent to this heating, the metal is quenched, that is submersed in a liquid such as oil or water, in order to further alter its crystalline structure, resulting in increased strength and hardness. Quite often, however, the design of the heat treating furnaces and quench tanks are such that a poor ergonomic functionality results. As a result, the user is hindered by things such as furnace doors that require a free hand to operate while maneuvering the metal objects and quench tanks or trays that are positioned at a remote location, requiring the user to transport the materials back and forth. Accordingly there is a constant need for new and innovative heat treating furnace designs that allows the user free use of his hands while providing the full functionality of conventional heat treating procedures. The development of the present invention fulfills this need.

A search of the prior art did not disclose any patents that read directly on the claims of the instant invention. However, several references teaching automated door assemblies were discovered. None of these disclosures, however, anticipate or disclose any embodiment that combine the features of the present invention. As a result, none of the prior art precludes the novelty and the utilitarian functionality of the present invention.

Several patents disclose mechanical door opening means wherein the user actuates the door via a foot pedal in order to open a cabinet or the like.

U.S. Pat. No. 5,622,416 issued in the name of Rainey et al.;

U.S. Pat. No. 5,540,012 issued in the name of Clegg;

U.S. Pat. No. 4,911,508 issued in the name of Tillman; and

U.S. Pat. No. 1,109,723 issued in the name of White.

Two patents disclose mechanical door opening means wherein the user opens the door to a trash receptacle via a foot pedal.

U.S. Pat. No. 5,163,574 issued in the name of Sosan; and

U.S. Pat. No. 5,147,056 issued in the name of Ma.

All of these disclosures are directed to mechanical means by which doors are opened via a foot pedal. Relying on a variety of linkage lever configurations or, cable and pulley arrangements, these devices transfer the force applied to a foot pedal by the user to the door in order to force it opened. None of these disclosures anticipate the use of a motorized or automated opening force activated by a foot-operated pedal switch.

The following patents describe a portable heating furnace-type devices used in both industrial and domestic settings.

U.S. Pat. No. 5,058,654 issued in the name of Simmons et al.; and

U.S. Pat. No. 4,026,264 issued in the name of Henriques. Neither of these patents disclose a heat treating furnace, nor do they anticipate any use related to metal hardening or other heat treatment purposes. Furthermore, neither disclosure includes any mention of any door opening assemblies, whether mechanical or automated.

U.S. Pat. No. 4,658,545 issued in the name of Ingham et al. discloses an automatic door opener and closer wherein conventional entrance/exit doors commonly found in commercial establishments are opened and closed automatically by an opening mechanism powered by an electric motor. The electric motor is connected to a speed reducing, torque increasing mechanism consisting of a series of belts and pulleys that cause a swing lever, attached to the door, to swing the door to the opened or closed position automatically as a person approaches. While this disclosure teaches an automated door opening apparatus, it does not anticipate any use in conjunction with a furnace or any industrial equipment whatsoever. Furthermore, this disclosure is directed to the opening and closing of a hinged door assembly rather than a sliding track type door assembly.

While several features exhibited within these references may be incorporated into this invention, alone and in combination with other elements, the present invention is sufficiently different so as to make it distinguishable over the prior art.

SUMMARY OF THE INVENTION

The present invention is an otherwise conventional heat treating furnace that is equipped with an automated access door that is controlled via a foot pedal switch. The door opening mechanism consists of an electric motor that drives a speed reducing, torque increasing winch attached to a roller chain and sprocket wheel system that is used to raise and lower a sliding track door. The motor is activated by depressing the foot pedal, causing the furnace door to open and remains open until the pedal is released. This provides the user with the ability to use both hands to access the interior compartment of the furnace in order to manipulate the objects placed therein. In the closed door position, the design of the door itself, combined with its weight, results in a gravity induced thermal seal between the furnace and the door that results in increased thermal efficiency of the unit. Also incorporated into the design is a stop button, located on the furnace control panel, that allows the door to be held in any position upon its depression.

It is therefore an object of the present invention to provide a heat treating furnace with an improved door opening means that raises and lowers a sliding track door assembly, using a winch in conjunction with a roller chain and sprocket wheel assembly.

It is therefore an object of the present invention to provide a heat treating furnace with an improved door opening means that incorporates the use of a speed reducing, torque increasing gearbox, driven by an electric motor, to operate a sprocket wheel device that raises and lowers the door via a roller chain.

It is another object of the present invention to provide a heat treating furnace with an improved door opening means that frees the users hands to concentrate on the workpiece being treated without compromising safety.

It is another object of the present invention to provide a heat treating furnace with an improved door opening means that can be halted in any position along its path of travel should the user so desire.

It is another object of the present invention to provide a heat treating furnace having a sliding track access door wherein a thermal seal between the door and the furnace is effectuated by a gravity induced fit.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

Figure 1:
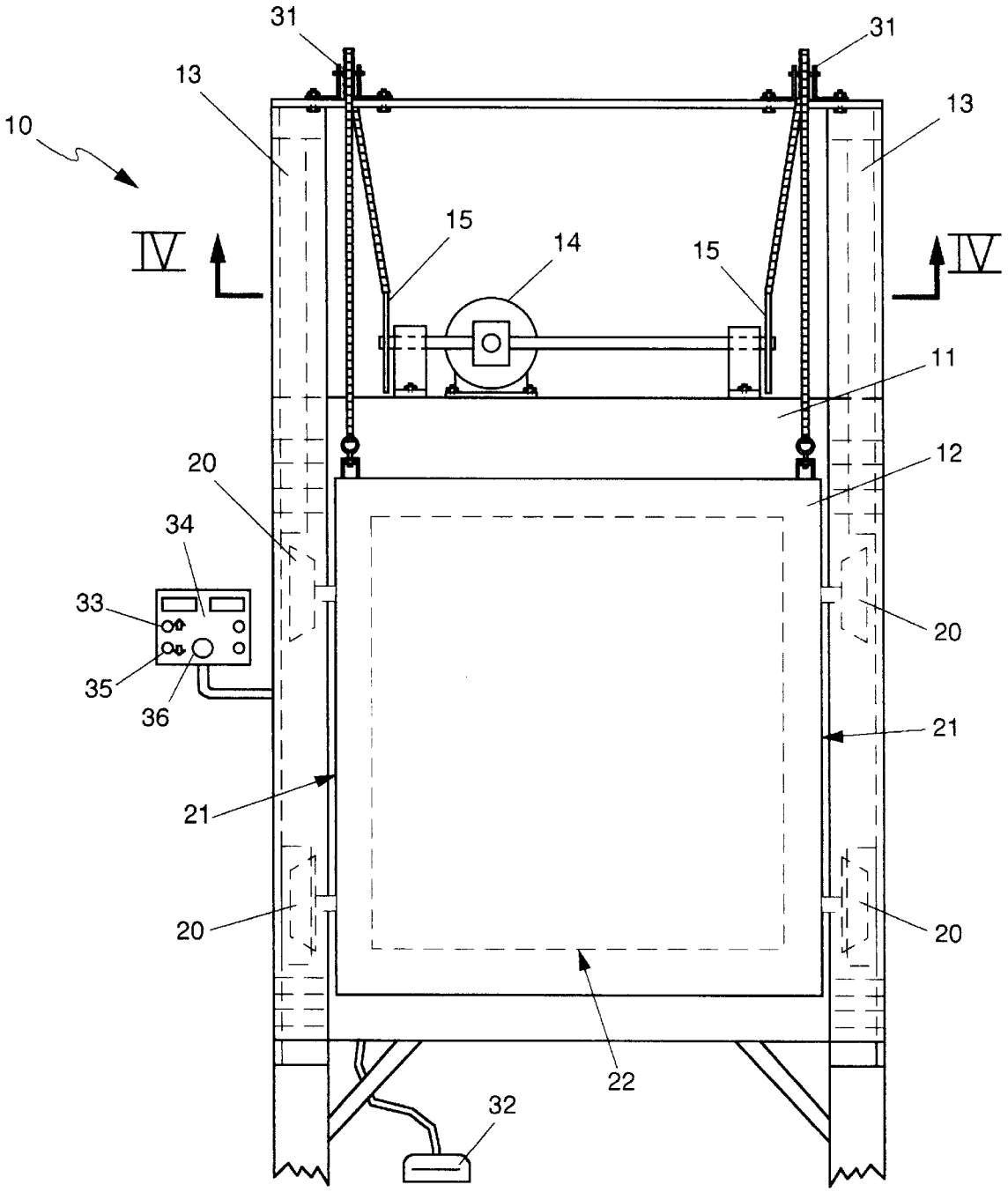
FIG. 1 is a front view of a heat treating furnace equipped with the automated door for heat treating furnaces, according to the preferred embodiment of the present invention.

10 Automated Door
11 Furnace
12 Furnace Door
13 Roller Tracks
14 Motor/Gearbox Combination
15 Sprocket Wheel
16 Quench Tank
20 Rollers
21 Vertical Edges
22 Furnace Heating Chamber
25 Furnace Facade
26 Closing Wheel Guide
27 Opening Wheel Guide
30 Roller Chain
31 Sprocket Wheel Assembly
32 Foot Switch
33 Open Pushbutton
34 Control Panel
35 Close Pushbutton
36 Emergency Stop Pushbutton

Description of the Preferred Embodiments

1. Detailed Description of the Figures

Referring now to the Figures, depicted is the automated door mechanism for heat treating furnaces, hereinafter automated door 10, installed upon and used in conjunction with a heat treating furnace, hereinafter furnace 11, according to the preferred embodiment of the present invention. The automated door 10 consists of a furnace door 12 attached to a pair of parallel roller tracks 13 that is raised and lowered in order to open and close the furnace 11 by a motor/gearbox combination 14 that drives a pair of sprocket wheels 15.

The roller tracks 13 are attached to the furnace 11 in a generally vertical direction, along the edges thereof in a position such that they extend above the furnace 11 a distance greater than the height of the furnace door 12. The furnace door 12 has several rollers 20 extending from the vertical edges 21 thereof. The roller tracks 13 are of a C-shaped cross-section that accepts the rollers 20 therein. Resting within the roller tracks 13, the furnace door 12 slides freely therein between an upward, opened position wherein the furnace heating chamber 22 is exposed to the outside atmosphere and a downward, closed position wherein the furnace heating chamber 22 is isolated from the outside atmosphere.

Figure 2:
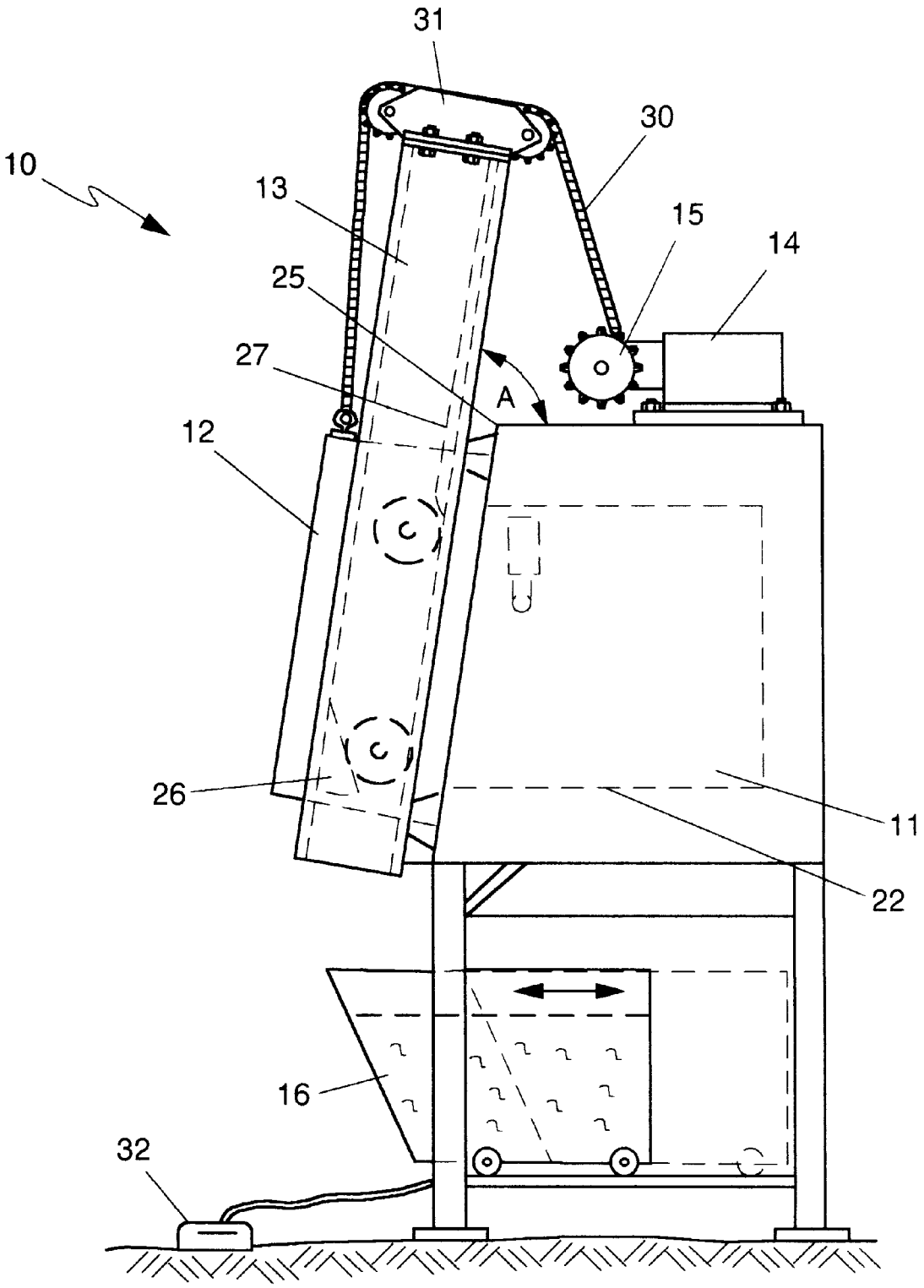
FIG. 2 is a side view of a heat treating furnace equipped with the automated door for heat treating furnaces depicting the door in the lowered, closed position, according to the preferred embodiment of the present invention.
Figure 3:
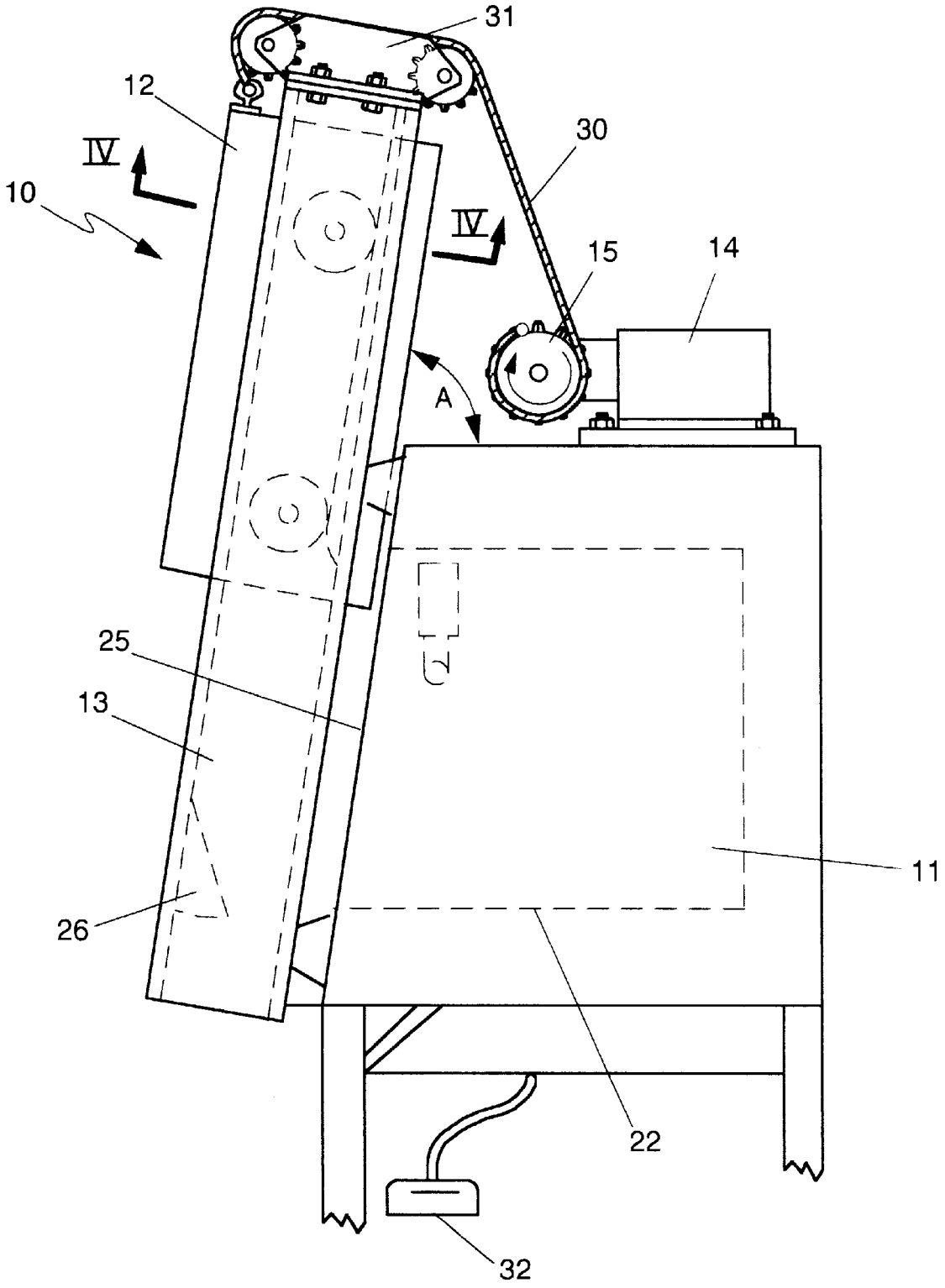
FIG. 3 is a side view of a heat treating furnace equipped with the automated door for heat treating furnaces depicting the door in the raised, opened position, according to the preferred embodiment of the present invention.
Figure 4:
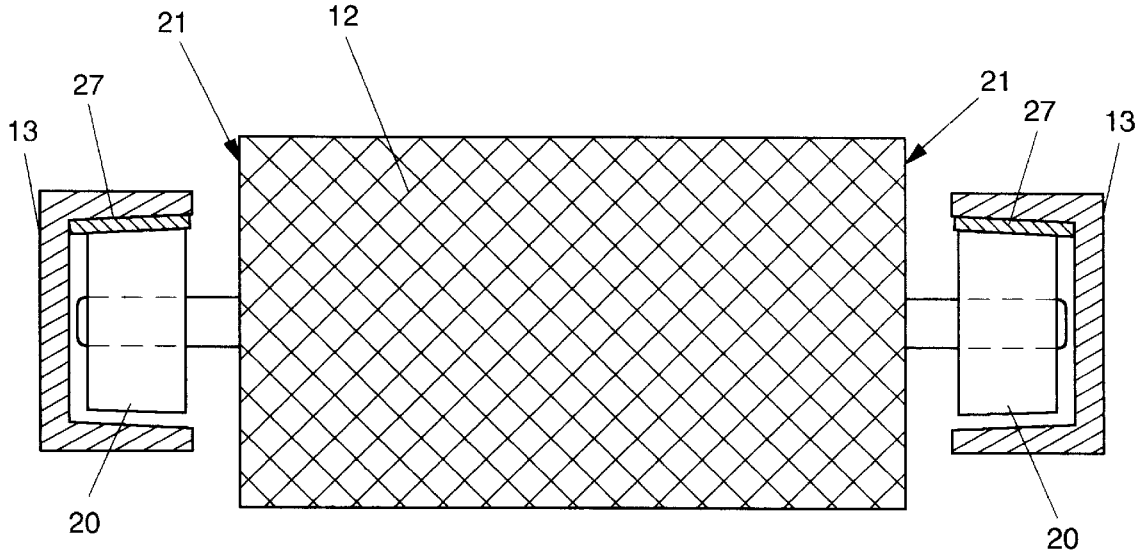
FIG. 4 is a top sectional view of a heat treating furnace equipped with the automated door for heat treating furnaces, according to the preferred embodiment of the present invention.

The roller tracks 13 are positioned at an acute angle A with respect to the furnace facade 25. As a result, a component of the weight of the furnace door 12 is directed toward the furnace facade 25, creating a seal there between that creates an enhanced thermal insulation between the heating chamber 22 and the outside atmosphere. A closing wheel guide 26, located within each roller track 13 near the lower end of furnace door 12 travel promotes the formation of the thermal insulating effect by increasing the force by which the furnace door 12 is pressed against the furnace facade 25 in the downward closed position (see, especially, FIG. 2). As the furnace door 12 is raised toward the upward opened position, an opening wheel guide 27 lifts the furnace door 12 from contact with the furnace facade 25 so as to prevent excessive frictional wear there between and to minimize resistance to travel (see, especially, FIG. 3).

The furnace door 12 is operated between the upward, opened position and the downward closed position by the motor/gearbox combination 14. The motor/gearbox combination 14 is connected to the furnace door 12 via a roller chain 30 that runs through a sprocket wheel assembly 31 located on top of the roller tracks 13 and spanning there between. The motor/gearbox combination 14 is electrically driven by a DC servo motor and incorporates the use of a speed reducing, torque increasing geartrain. The DC servo motor design allows for reverse direction operation and allows the furnace door 12 to be incrementally opened or maintained in any position along its travel. The winch is activated by the user via a foot switch 32 or by an open pushbutton 33 located on a control panel 34. The control circuit that activates the motor/gearbox combination 14 is of an unsealed nature, the result being that the motor/gearbox combination 14 raises the door as long as either the foot switch 32 or open pushbutton 33 are depressed. When the foot switch 32 or open pushbutton 33 are released, the furnace door 12 is stopped, maintaining its current position. The door is closed upon depressing a close pushbutton 35. An emergency stop pushbutton 36 stops the motor/gearbox combination 14 and the travel of the furnace door 12 regardless of the status of the foot switch 32 of open pushbutton 33. As an additional safety precaution, there are a pair of limit switches (not shown in the Figures) that monitor the position of the furnace door 12, allowing it to raise and lower to predetermined levels.

2. Operation of the Preferred Embodiment

In accordance with the preferred embodiment of the present invention and as shown in the Figures, the automated door 10 is used in the following manner. The furnace 11 is brought up to operating conditions by powering it and setting the appropriate heating temperature, often in upwards of 2000 degrees Fahrenheit. The user opens the furnace door 12 by either depressing the foot switch 32 or the open pushbutton 33. When the furnace door 12 reaches a height sufficient to place the workpiece (not shown) inside the heating chamber 22, the foot switch 32 or the open pushbutton 33, whichever the case may be, is released and the furnace door 12 stops and is suspended in place. The user then places the workpiece inside the furnace 11 and depresses the close pushbutton 35. The furnace door 12 then closes and the workpiece is heated to the appropriate temperature for heat treating. If, at any time during the use of the automated door 10, the need arises to stop the motion of the furnace door 12, the user simply hits the emergency stop pushbutton 36. Depression of the emergency stop pushbutton 36, even if momentary, will stop the travel of the furnace door 12 until another control command is issued by the operator.

Once the work piece has been heated for the appropriate duration of time, the user again opens the furnace door 12 in the aforementioned manner. In the case where quenching is required in the heat treating process, a quench tank 16 may be attached to or placed upon a sliding drawer device attached to the underside of the furnace 11. Incorporation of the sliding drawer allows for easy and convenient completion of the heat treating process.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. An automated door mechanism for conventional heat treating furnaces comprising: a sliding door configuration wherein a furnace door for accessing a heat treating chamber slides in a generally vertical direction along the facade of said heat treating furnace, said automated door mechanism comprising:

motorized means for producing a rotational force, said motorized means adapted for mounting to the exterior surface of said heat treating furnace;

rotational force translation means for converting said rotational force to a linear force;

linear force redirection means for directing said linear force along a directional path generally parallel to said facade of said heat treating furnace, said linear force redirection means adapted for mounting to the exterior surface of said heat treating furnace;

securing means for applying said linear force to said furnace door; and control means for controlling the activation and rotational direction of said motorized means;

whereby said furnace door can be opened and closed automatically, allowing the user to handle a workpiece freely and without the obstruction typically encountered in manually operating said furnace door.

2. The automated door mechanism of claim 1, wherein said motorized means further comprises an electric motor in combination with a gear reducing mechanism, said gear reducing mechanism driving a wheel sprocket, producing said rotational force.

3. The automated door mechanism of claim 1, wherein said rotational force translation means further comprises a roller chain having links that coincide with the size and spacing of the individual teeth on said wheel sprocket, said roller chain converting said rotational force to said linear force.

4. The automated door mechanism of claim 1, wherein said linear force redirection means further comprises a sprocket wheel assembly having at least one redirecting sprocket wheel wherein said roller chain engages with the teeth of said redirecting sprocket wheel, wrapping partially around its circumference, whereby said linear force is redirected along a directional path generally parallel to said facade of said heat treating furnace.

5. The automated door mechanism of claim 1, wherein said controlling means further comprises a foot actuated pedal wherein, upon depressing said foot actuated pedal, said motorized means is activated, causing said furnace door to raise until said foot actuated pedal is released.

6. The automated door mechanism of claim 1, wherein an emergency stop pushbutton de-activates said automated door mechanism regardless of the state of said control means.

7. The automated door mechanism of claim 1, wherein furnace door travel limiting safety switches limits the travel of said furnace door in both the extreme opened or closed positions.

* * * * *